US007281759B1

(12) United States Patent
Strong et al.

(10) Patent No.: US 7,281,759 B1
(45) Date of Patent: Oct. 16, 2007

(54) PORTABLE HIGH CHAIR

(76) Inventors: Kim Strong, 14014 Spring Mill Rd., Louisville, KY (US) 40245; Jamye Baker, P.O. Box 143, Leiters Ford, IN (US) 46945

( * ) Notice: Subject to any disclaimer, the term of this patent is extended or adjusted under 35 U.S.C. 154(b) by 0 days.

(21) Appl. No.: 11/469,525

(22) Filed: Sep. 1, 2006

Related U.S. Application Data

(60) Provisional application No. 60/596,323, filed on Sep. 16, 2005.

(51) Int. Cl.
*A47C 4/28* (2006.01)

(52) U.S. Cl. ..... 297/45; 297/16.1; 297/135; 297/256.15; 297/487; 297/153

(58) Field of Classification Search ..... 297/16.1, 297/42, 45, 135, 148, 150, 154, 256.15, 487, 297/153
See application file for complete search history.

(56) References Cited

U.S. PATENT DOCUMENTS

| | | | | |
|---|---|---|---|---|
| 2,002,765 | A * | 5/1935 | Carpenter | 248/618 |
| 2,282,086 | A * | 5/1942 | Peltier | 280/87.05 |
| 2,919,748 | A * | 1/1960 | Alden, Sr. | 297/153 |
| 3,145,048 | A * | 8/1964 | Dowdy et al. | 297/5 |
| 5,131,715 | A * | 7/1992 | Balles | 297/5 |
| 6,247,750 | B1 * | 6/2001 | Tsai | 297/16.2 |
| 6,454,348 | B1 * | 9/2002 | Wu | 297/16.2 |
| 2005/0073181 | A1 * | 4/2005 | Anton | 297/135 |

* cited by examiner

*Primary Examiner*—Laurie K. Cranmer
(74) *Attorney, Agent, or Firm*—Camoriano and Associates; Theresa Fritz Camoriano

(57) ABSTRACT

A portable high chair including a flexible seat portion, a flexible tray portion, and a flexible restraint portion secured to both the seat portion and the tray portion.

3 Claims, 2 Drawing Sheets

PORTABLE HIGH CHAIR

BACKGROUND

This application claims priority from U.S. Provisional Application Ser. No. 60/596,323 filed Sep. 16, 2005, which is hereby incorporated by reference.

The present invention relates to a folding chair. More particularly, it relates to a portable high chair for use with a young child.

SUMMARY

The present invention provides a folding high chair. In a preferred embodiment, the chair includes an integral tray, preferably with a clear vinyl cover over the entire tray upper surface for ease of cleaning the tray.

DESCRIPTION OF THE PREFERRED EMBODIMENT

Figure 1:
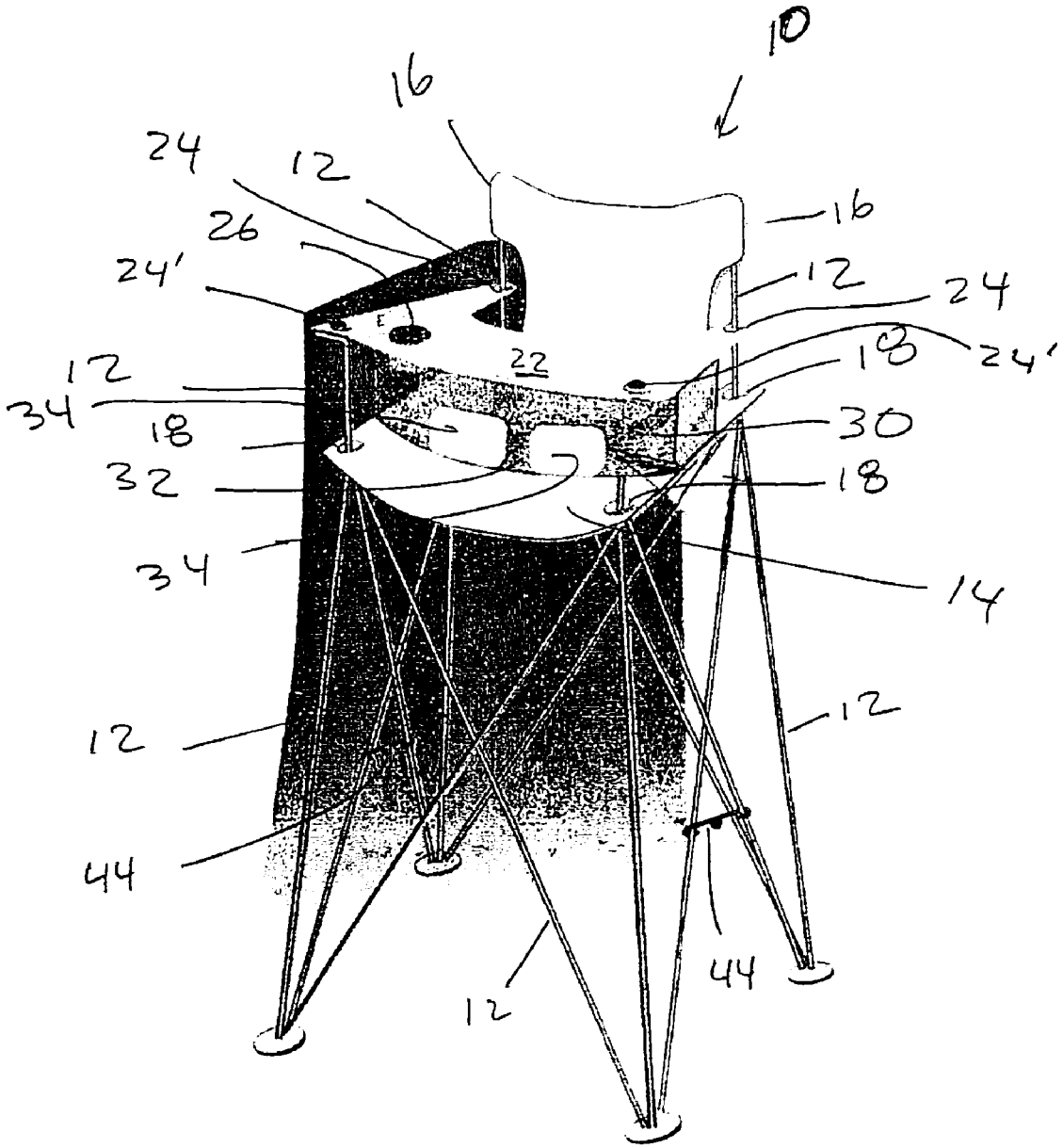
FIG. 1 is a perspective view of a portable high chair made in accordance with the present invention.

FIGS. 1-5 show a high chair 10 made up of a plurality of tubular legs 12, which are pivotably connected together with a scissor-type mechanism as is well-known in the art for fold-up chairs. (See U.S. Pat. Nos. 6,082,813; 6,755,462; and 6,382,715, which are hereby incorporated herein by reference.) As with known fold-up chairs, a seat 14, made of a flexible material, such as cloth or vinyl, is suspended on the legs 12. The seat back defines pockets 16, which receive two upwardly-projecting tubular legs 12. The four corners of the seat 14 have grommets 18, which receive the tubular legs 12.

A flexible tray 22 is also suspended on the legs 12. The tray 22 is made of a similar material to that of the seat 14 and extends around the left and right sides and the front, suspended above the seat 14. A clear vinyl layer is laminated on top of the cloth material for the tray 22, making it easy to wipe off for cleaning. This vinyl layer may be made from some other impermeable material for ease of cleansing. The tray 22 also has grommets 24 at its two rear corners, which receive the same rear legs as the seat 14, and it has receptacles 24' at its two front corners, which receive two front legs. The receptacles 24' are secured to the tray 22 and have a substantially tubular shape and are closed at the top end. The front tubular legs 12 that are received in the receptacles 24' are angled outwardly at the top, keeping the tray in tension so it remains substantially flat when the high chair is in its extended position. The tray also defines a recess 26 for receiving a cup.

Figure 2:
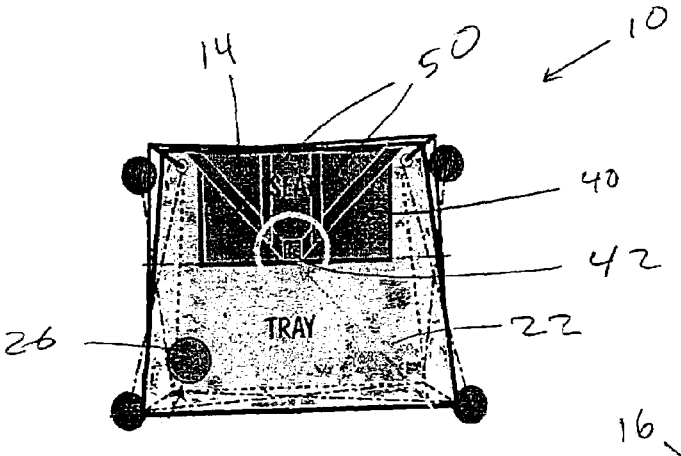
FIG. 2 is a top view of the high chair of FIG. 1.
Figure 3:
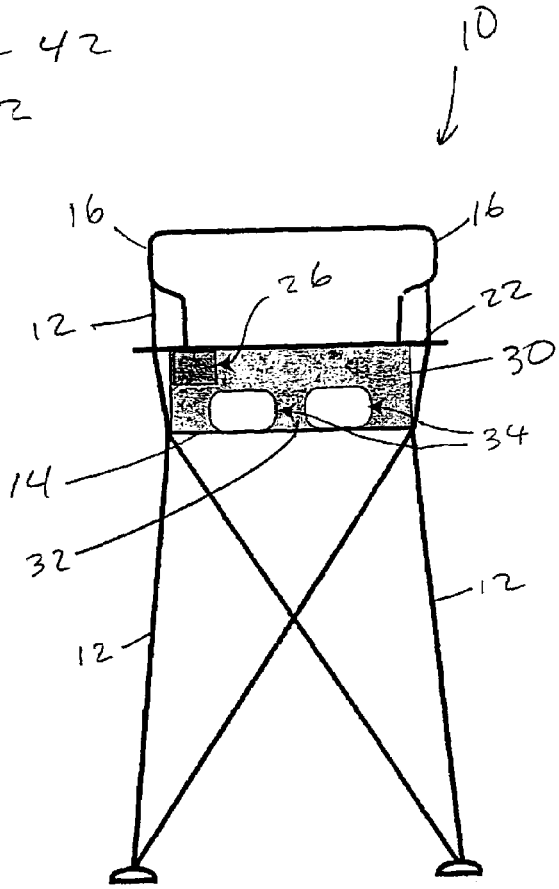
FIG. 3 is a front view of the high chair of FIG. 1 (with child restraints omitted for clarity)
Figure 4:
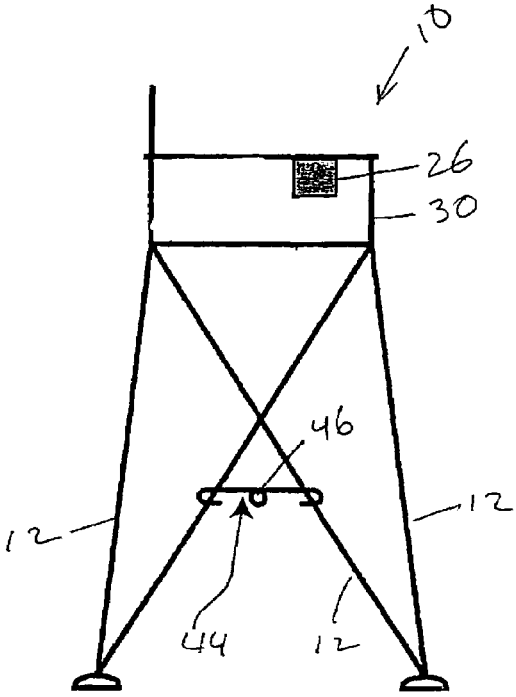
FIG. 4 is a side view of the high chair of FIG. 1.

There are two types of restraints for holding a child in the high chair 10. First, there is a flexible restraint 30, which is stitched or otherwise secured along its top edge to the tray 22 and along its bottom edge to the seat 14. This restraint 30 includes a crotch strip 32 and defines two leg openings 34. This restraint 30 is made of a flexible material similar to the material from which the seat and tray are made. Referring briefly to FIG. 2, there is also a seat belt arrangement including a lap belt 40 and crotch strap 42, secured to the seat 14. This seat belt arrangement can also be enhanced by including a shoulder harness 50.

A locking support 44 is located on each side of the chair 10, tying the legs 12 together. Each locking support 44 includes two arms, each of which is permanently pivotably secured to its respective leg 12. The two arms are connected together at a central pivot point 46 (See FIG. 4), which allows the arms to pivot downwardly in order to fold up the chair, but the arms are restricted so they cannot pivot upwardly. (This type of locking support 44 is well-known in fold-up tables.)

This chair 10 can be folded up (to its retracted or collapsed position) in the same manner as other similar fold-up chairs, and the tray 22 and restraint 30 fold up along with the rest of the chair, so the folded chair 10 can be received in a bag or tote to be carried from place to place. When the user gets to the place where he wants to use the chair, he simply removes it from the bag, opens it up, pivoting the legs 12 into their extended position, and puts the child in to the chair 10, putting the child's legs through the openings 34 and securing the child with the straps 40, 42 (as well as with the shoulder harness 50). The child's meal can be placed on the tray 22, and the cup can be placed in the cup holder 26. When the meal is over, the child is removed from the chair 10, and the chair is again folded up and returned to the bag to be carried again.

The flexible seat portion 14 has front, rear, left and right sides, as does the flexible tray portion 22. The grommets 18 on the seat 14 define four independent, spaced-apart seat suspension points at the four corners of the seat, including a left front point, a right front point, a left rear point, and a right rear point. Each grommet 18 defines an opening that receives a respective leg 12. The rear side of the tray 22 has a substantially U shape, so it can wrap around the front and sides of the child who sits on the seat portion 14. The tray portion 22 includes a central table portion that extends laterally from left to right across the front of the tray portion, a left arm support portion extending rearwardly from the left side of the central table portion to the rear of the tray portion, and a right arm support extending rearwardly from the right side of the central table portion to the rear of the tray portion. The tray portion 22 is supported at four independent, spaced-apart tray suspension points, which are above the seat suspension points. The grommets 24 at the rear of the left and right arm support portions form the left and right rear tray suspension points and define left and right rear openings, which receive the same legs 12 as are received in the left and right rear grommets 18 on the seat 14, respectively. The receptacles 24' define the left and right front tray suspension points and define left and right front openings that receive the same legs 12 as are received in the left and right front grommets 18 of the seat 14, respectively. The flexible restraint panel 30 has a U-shaped profile, including a front panel portion that extends between the table part of the tray 22 and the seat portion 14 and left and right side panel portions that extend between the seat portion and the left and right arm support portions, respectively.

It will be obvious to those skilled in the art that modifications may be made to the embodiment described above without departing from the scope of the present invention.

What is claimed is:

1. A portable high chair, comprising:

a plurality of tubular legs including means for moving said legs from a first, collapsed position to a second, extended position;

a flexible seat portion having front, rear, left and right sides and suspended from said legs at four independent, spaced-apart seat suspension points, including a left front point, a left rear point, a right front point, and a right rear point, such that said seat portion collapses with said legs when said legs are in the collapsed position and extends to a substantially flat position when said legs are in said second, extended position;

a flexible tray portion also having front, rear, left and right sides, with the rear side having a substantially U shape for wrapping around the front and sides of a child who is to sit on the seat portion, said flexible tray portion including a central table portion extending laterally from left to right across the front; a left arm support portion extending rearwardly from the left side of the central table portion; and a right arm support portion extending rearwardly from the right side of the central table portion; said flexible tray portion being suspended from said legs at four independent, spaced-apart tray suspension points above said four seat suspension points, including left and right front tray suspension points on said central table portion and left and right rear tray suspension points on the rear of said left and right arm support portions, respectively, such that said tray portion is collapsed when said legs are in a collapsed position and is extended to a substantially flat position when said legs are in said second, extended position; and a flexible restraint panel defining leg openings, said flexible restraint panel extending between said seat portion and said table portion.

2. A portable high chair as recited in claim 1, wherein each of said suspension points defines an opening, and said tubular legs include a left front leg that extends through the openings at the left front seat suspension point and the left front tray suspension point; a right front leg that extends through the openings at the right front seat suspension point and the right front tray suspension point; a left rear leg that extends through the openings at the left rear tray suspension point and left rear seat suspension point; and a right rear leg that extends through the openings at the right rear tray suspension point and the right rear seat suspension point.

3. A portable high chair as recited in claim 2, wherein said flexible restraint panel has a U shaped profile and includes left and right side panel portions that extend between the seat portion and the left and right arm support portions, respectively.

* * * * *